US010649404B2

(12) United States Patent
Aoki

(10) Patent No.: US 10,649,404 B2
(45) Date of Patent: May 12, 2020

(54) IMAGE FORMING APPARATUS

(71) Applicant: CANON KABUSHIKI KAISHA, Tokyo (JP)

(72) Inventor: Kohei Aoki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/522,808

(22) Filed: Jul. 26, 2019

(65) Prior Publication Data

US 2020/0033800 A1 Jan. 30, 2020

(30) Foreign Application Priority Data

Jul. 30, 2018 (JP) ..... 2018-142125

(51) Int. Cl.
*G03G 21/20* (2006.01)
*B41J 11/00* (2006.01)

(52) U.S. Cl.
CPC ..... *G03G 21/203* (2013.01); *B41J 11/002* (2013.01); *B41J 11/0005* (2013.01); *G03G 21/206* (2013.01)

(58) Field of Classification Search
CPC ..... G03G 15/6502; G03G 2215/00383; G03G 21/20; G03G 21/203; G03G 21/206; B65H 2407/31; B65H 2407/311
See application file for complete search history.

(56) References Cited

U.S. PATENT DOCUMENTS 5,355,204 A 10/1994 Aoki
5,629,094 A 5/1997 Sakakibara et al.
2010/0158593 A1* 6/2010 Clark ..... G03G 21/203 399/390

FOREIGN PATENT DOCUMENTS

JP 2002-274678 A 9/2002
JP 2005-330079 A 12/2005

OTHER PUBLICATIONS

Ikeuchi et al., JP 2005-330079 A, Dec. 2005, JPO Computer Translation (Year: 2005).*

* cited by examiner

*Primary Examiner* — Erika J Villaluna
(74) *Attorney, Agent, or Firm* — Venable LLP

(57) ABSTRACT

An image forming apparatus including a sheet storage portion in which a plurality of sheets is stored; a heater which heats air; a fan which sprays air on the sheet stored in the sheet storage portion; and a controller which controls the heat of the heater and controls the drive of the fan, in which the controller controls the heat of the heater at a first temperature before a drive time of the fan reaches a threshold value set in advance, the drive time being in which the fan sprays air heated by the heater on the sheet, and when the drive time of the fan reaches or exceeds the threshold value set in advance, controls the heat of the heater at a second temperature lower than the first temperature.

6 Claims, 14 Drawing Sheets

FIG. 10

AIR HEATER TEMPERATURE FOR COATED PAPER WITH 70 TO 110 g

| TEMPERATURE ℃ | ADJUSTMENT TEMPERATURE 1 (AIR HEATER TEMPERATURE[℃]) / ADJUSTMENT TEMPERATURE 2 (SET TEMPERATURE[℃] AFTER ADJUSTMENT TEMPERATURE DOWN) | | | | | |
|---|---|---|---|---|---|---|
| 41~ | 75/60 | 75/60 | 90/75 | 90/75 | 90/75 | 110/75 |
| 36~40 | 60/45 | 60/45 | 60/45 | 75/60 | 90/60 | 90/60 |
| 26~35 | 45/OFF | 45/OFF | 45/OFF | 60/45 | 60/45 | 90/60 |
| 16~25 | OFF/OFF | 30/OFF | 30/OFF | 45/30 | 45/30 | 60/45 |
| 6~15 | OFF/OFF | OFF/OFF | OFF/OFF | 30/15 | 30/15 | 45/30 |
| 5 or less | OFF/OFF | OFF/OFF | OFF/OFF | OFF/OFF | 30/15 | 30/15 |
| | HUMIDITY 0~25[%] | HUMIDITY 26~35[%] | HUMIDITY 36~45[%] | HUMIDITY 46~60[%] | HUMIDITY 46~60[%] | HUMIDITY 61~[%] |

AIR HEATER TEMPERATURE FOR COATED PAPER WITH 110 TO 250 g

| TEMPERATURE ℃ | ADJUSTMENT TEMPERATURE 1 (AIR HEATER TEMPERATURE[℃]) / ADJUSTMENT TEMPERATURE 2 (SET TEMPERATURE[℃] AFTER ADJUSTMENT TEMPERATURE DOWN) | | | | | |
|---|---|---|---|---|---|---|
| 41~ | 75/60 | 90/75 | 90/75 | 90/75 | 90/75 | 110/75 |
| 36~40 | 60/45 | 60/45 | 75/60 | 75/60 | 75/60 | 110/75 |
| 26~35 | 45/OFF | 45/OFF | 60/45 | 60/45 | 60/45 | 90/60 |
| 16~25 | 30/OFF | 30/OFF | 45/30 | 45/30 | 45/30 | 60/45 |
| 6~15 | OFF/OFF | OFF/OFF | 30/15 | 30/15 | 45/30 | 45/30 |
| 5 or less | OFF/OFF | OFF/OFF | OFF/OFF | 30/15 | 30/15 | 30/15 |
| | HUMIDITY 0~25[%] | HUMIDITY 26~35[%] | HUMIDITY 36~45[%] | HUMIDITY 46~60[%] | HUMIDITY 46~60[%] | HUMIDITY 61~[%] |

AIR HEATER TEMPERATURE FOR COATED PAPER WITH 250 g OR MORE

| TEMPERATURE ℃ | ADJUSTMENT TEMPERATURE 1 (AIR HEATER TEMPERATURE[℃]) / ADJUSTMENT TEMPERATURE 2 (SET TEMPERATURE[℃] AFTER ADJUSTMENT TEMPERATURE DOWN) | | | | | |
|---|---|---|---|---|---|---|
| 41~ | 75/60 | 90/75 | 90/75 | 90/75 | 90/75 | 110/75 |
| 36~40 | 60/45 | 75/60 | 75/60 | 75/60 | 75/60 | 110/75 |
| 26~35 | 45/OFF | 60/45 | 60/45 | 60/45 | 60/45 | 90/60 |
| 16~25 | 30/OFF | 45/30 | 45/30 | 45/30 | 45/30 | 60/45 |
| 6~15 | OFF/OFF | 30/15 | 30/15 | 45/30 | 45/30 | 45/30 |
| 5 or less | OFF/OFF | OFF/OFF | 30/15 | 30/15 | 30/15 | 30/15 |
| | HUMIDITY 0~25[%] | HUMIDITY 26~35[%] | HUMIDITY 36~45[%] | HUMIDITY 46~60[%] | HUMIDITY 46~60[%] | HUMIDITY 61~[%] |

IMAGE FORMING APPARATUS

BACKGROUND OF THE INVENTION

Field of the Invention

The present invention relates to an image forming apparatus equipped with a sheet storage portion which stores a plurality of sheets, such as an electrophotography copying machine, a facsimile machine, or a printer.

Description of the Related Art

For image forming apparatuses such as a copying machine and a printer, more variety of recording media has been used. Examples of recording media to be used include board, thin paper, over head transparency (OHT) paper made of transparent sheet for over head projector (OHP), and tracing paper. Additionally, due to a market demand for coloring, there is an increasing demand for forming an image on sheet with a smooth surface such as art paper or coated paper with a sheet surface coated for exhibiting whiteness and gloss.

These OHT paper, tracing paper, art paper, and coated paper are very smooth and have low air permeability (hardly allows air to pass). Therefore, in a case where sheets are stacked under high humidity environment, the sheets are adhered to each other to cause overlapped feeding or misfeeding which cannot be prevented only by a friction separating system commonly used in a copying machine, a printer, etc.

Under these circumstances, there is proposed a technique for dehumidifying a sheet by heat generated by a heater and further dehumidifying a roller by a part of the heat generated by the heater (Japanese Patent Laid-Open No. 2002-274678). There is also proposed a technique for measuring temperature and humidity of air which loosens a sheet to control temperature and humidity of the air itself for the purpose of preventing reduction in sheet loosening performance due to variation of temperature and humidity of air (Japanese Patent Laid-Open No. 2005-330079).

However, in Japanese Patent Laid-Open No. 2002-274678, when a sheet is continuously dehumidified by heat generated by the heater, a moisture content is reduced only in a part of a sheet subjected to heat. Then, when a sheet having ununiform moisture content enters a high temperature fixing nip, the sheet expands or contracts to be uneven, resulting in having wrinkles. Additionally, in Japanese Patent Laid-Open No. 2005-330079, while temperature and humidity of air itself are controlled, a moisture content of a sheet is not controlled. Therefore, the problem that a moisture content of a sheet is partly reduced is yet to be solved.

SUMMARY OF THE INVENTION

It is therefore desirable in the present invention to suppress a partial reduction in a moisture content of a sheet to thereby suppress wrinkles of the sheet.

In order to achieve the above object, the present invention relates to an image forming apparatus including a sheet storage portion in which a plurality of sheets is stored; a heater which heats air; a fan which sprays air on the sheet stored in the sheet storage portion; and a controller which controls the heat of the heater and controls the drive of the fan, in which the controller controls the heat of the heater at a first temperature before a drive time of the fan reaches a threshold value set in advance, the drive time being in which the fan sprays air heated by the heater on the sheet, and when the drive time of the fan reaches or exceeds the threshold value set in advance, controls the heat of the heater at a second temperature lower than the first temperature.

According to the present invention, a partial reduction in a moisture content of a sheet can be suppressed to obtain an effect of suppressing wrinkles of the sheet.

Further features of the present invention will become apparent from the following description of the exemplary embodiments with reference to the attached drawings.

BRIEF DESCRIPTION OF THE DRAWINGS

FIG. 10 is a diagram showing one example of an adjustment temperature table of a heater relative to temperature and humidity of a storage;

DESCRIPTION OF THE EMBODIMENTS

In the following, preferable embodiments of the present invention will be exemplarily described in detail with reference to the drawings. However, size, material, shape, and relative arrangement of components, etc. recited in the embodiments below should be appropriately changed according to a configuration of a device to which the present invention is applied and other various conditions. Accordingly, unless otherwise recited, the scope of the present invention should not be construed as being limited thereto.

First Example

<Image Forming Apparatus>

Figure 1:
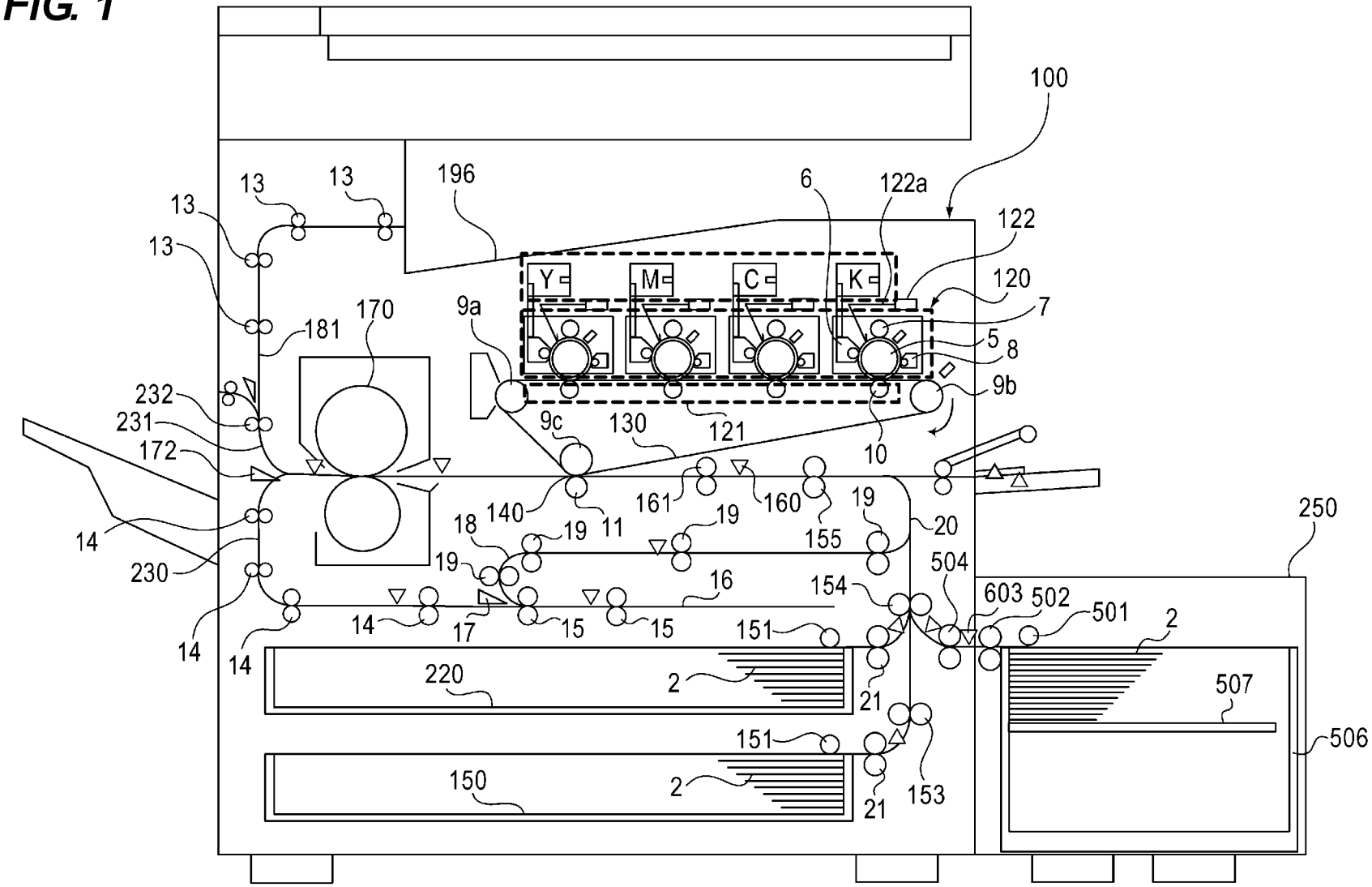
FIG. 1 is an explanatory sectional view showing a configuration of an image forming apparatus.
Figure 2:
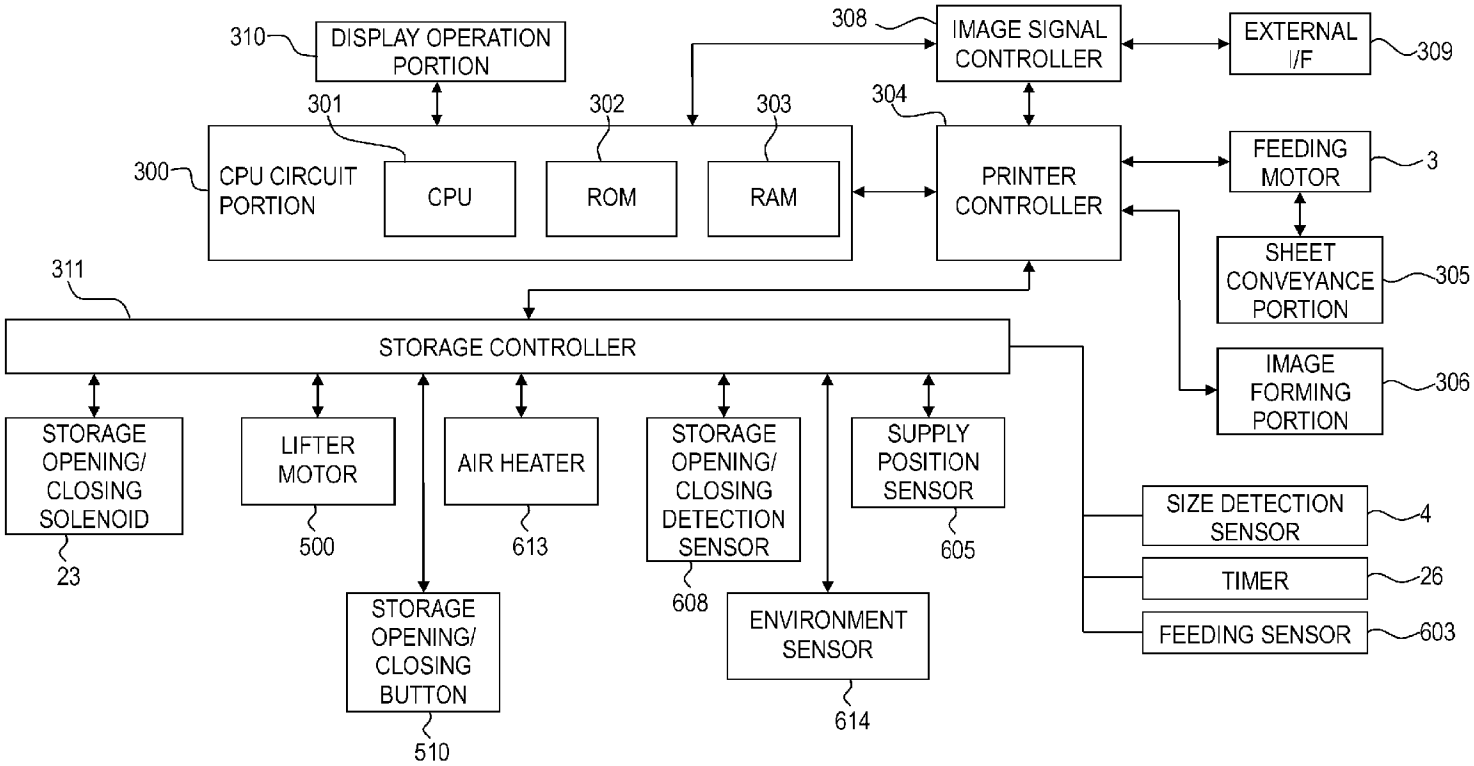
FIG. 2 is a block diagram showing a configuration of a controller of the image forming apparatus.

With reference to FIG. 1 and FIG. 2, a configuration of an image forming apparatus 100 will be described. FIG. 1 is an explanatory sectional view showing the configuration of the image forming apparatus 100. FIG. 2 is a block diagram showing a configuration of a controller of the image forming apparatus 100. A central processing unit (CPU) circuit portion 300 shown in FIG. 2 includes a CPU 301 as a controller, a ROM 302, and a RAM 303 and conducts system control of the image forming apparatus 100 shown in FIG. 1.

An image signal controller 308 subjects a digital image signal input via an external I/F (interface) 309 to various processing during print operation, converts the digital image signal to a video signal, and stores the video signal in the RAM 303. A printer controller 304 instructs an image forming portion 306 to form an image on the basis of an instruction from the CPU 301. The image forming portion 306 drives a process unit 120 on the basis of the input video signal shown in FIG. 1.

The printer controller 304 controls a sheet conveyance portion 305 to feed and convey a sheet 2 on the basis of an instruction from the CPU 301. A display operation portion 310 conducts selection of a color mode in which image formation is conducted, input of sheet information, display of a state of the image forming apparatus 100, instruction to start printing, etc. A storage controller 311 controls a height position of the sheet 2 stacked on a lift board 507 in a storage 506 shown in FIG. 1 by controlling the drive of a lifter motor 500 on the basis of detection results of a storage opening/closing detection sensor 608 and a supply position sensor 605.

<Image Forming Operation>

Next, with reference to FIG. 1 and FIG. 2, image forming operation of the image forming apparatus 100 will be described.

Upon input of an instruction to start operation of printing on the sheet 2 fed from a sheet deck 250 via the display operation portion 310 or the like, the CPU 301 drives rotation of a feeding motor 3 shown in FIG. 2 as a drive source for a pick-up roller 501 and a feeding roller 502. As a result, the pick-up roller 501 and the feeding roller 502 are driven to rotate, resulting in separately feeding the sheets 2 stacked on the lift board 507 in the storage 506 housed in the sheet deck 250 one by one. At this time, the CPU 301 monitors whether the operation of feeding the sheet 2 has been normally conducted or not by using the feeding sensor 603.

Upon input of an instruction to start the operation of printing on the sheet 2 fed from a sheet cassette 150 or a sheet cassette 220, the motor is similarly driven. As a result, a pick-up roller 151 and a feeding roller 21 are driven to rotate to separately feed the sheets 2 stored in the sheet cassette 150 or the sheet cassette 220 one by one.

On the other hand, the CPU 301 starts image forming operation in the process unit 120 in time for arrival of the sheet 2 at a secondary transfer nip portion 140 shown in FIG. 1. The CPU 301 calculates a size of the sheet 2 by a size detection sensor 4 shown in FIG. 2 in the sheet deck 250 or determines an image formation size on the basis of the size of the sheet 2 input from the display operation portion 310.

The process unit 120 is configured with a photosensitive drum 5 as an image bearing member, a developing device 6 as a developing portion, a charging roller 7 as a charging portion, a cleaner 8 as a cleaning portion, and the like. The process unit 120 is here provided for each color of yellow (Y), magenta (M), cyan (C), and black (K) and is detachable from the image forming apparatus. In each process unit 120, a surface of the photosensitive drum 5 which rotates counterclockwise in FIG. 1 is uniformly charged by the charging roller 7. Thereafter, the surface of the photosensitive drum 5 is irradiated with a laser light 122*a* according to image information emitted from a laser scanner unit 122 as an exposure portion. As a result, an electrostatic latent image is formed on the surface of the photosensitive drum 5. The electrostatic latent image formed on the surface of the photosensitive drum 5 is supplied with a toner (developer) stored in the developing device 6 so as to be developed as a toner image.

An intermediate transfer belt 130 extending between extension rollers 9*a* to 9*c* so as to be rotatable clockwise in FIG. 1 is provided to be opposed to the photosensitive drum 5. A transfer roller 10, as a primary transfer portion, is provided on an inner circumference surface side of the intermediate transfer belt 130 so as to be opposed to each photosensitive drum 5. A primary transfer bias is applied to the transfer roller 10 from a primary transfer bias power source (not shown).

As a result, a toner image of each color formed on the surface of each photosensitive drum 5 is primarily transferred and superimposed in order on an outer circumference surface of the intermediate transfer belt 130 in a primary transfer nip portion 121 formed by the surface of each photosensitive drum 5 and the outer circumference surface of the intermediate transfer belt 130. The intermediate transfer belt 130 rotates clockwise in FIG. 1. As a result, the toner image primarily transferred and superimposed on the outer circumference surface of the intermediate transfer belt 130 arrives at the secondary transfer nip portion 140 formed by a secondary transfer roller 11 as a secondary transfer portion and the outer circumference surface of the intermediate transfer belt 130.

On the other hand, the sheets 2 stored in the storage 506 in the sheet deck 250 are dispensed from the top by the pick-up roller 501 and separately fed by the feeding roller 502 one by one. Thereafter, the sheets 2 are nipped and drawn by a drawing roller 504 provided on the side of a main body of the image forming apparatus 100. The sheets 2 nipped and conveyed by the drawing roller 504 are further nipped and conveyed by conveying rollers 154 and 155. The CPU 301 monitors a detection result of a pre-registration detection sensor 160 which detects a position of the sheets 2 conveyed by the drawing roller 504, the conveying rollers 154 and 155 in order, thereby detecting the sheet 2 reaching or not reaching the position of the pre-registration detection sensor 160.

Sheets can be also selectively fed from the sheet cassette 150 or the sheet cassette 220. The sheets 2 separately fed from the sheet cassette 150 or the sheet cassette 220 are nipped and conveyed by conveying rollers 153, 154 and 155.

A front end of the sheet 2 nipped and conveyed by the conveying roller 155 arrive at the pre-registration detection sensor 160. Then, the CPU 301 causes the conveying roller 155 to nip and convey the sheet 2 by a prescribed amount with the front end of the sheet 2 being abutted on a nip portion of a registration roller 161 stopping on the basis of a detection result of the pre-registration detection sensor 160. This allows the sheet 2 to form a loop to correct skew feeding.

The sheet 2 forms a loop in a state where the front end of the sheet 2 is abutted on the nip portion of the stopping registration roller 161. Thereafter, the sheet 2 nipped by the conveying roller 155 is stopped. Thereafter, time of arrival of the front end of the sheet 2 at the pre-registration detection sensor 160 and time required for the sheet 2 to form a loop are considered. Then, the registration roller 161 is driven to rotate such that the front end of the sheet 2 and a front end portion of a toner image secondarily transferred on the outer circumference surface of the intermediate transfer belt 130 coincide with each other at the secondary transfer nip portion 140. Then, the sheet 2 is nipped and conveyed by the registration roller 161.

A secondary transfer bias is applied from a secondary transfer bias power source (not shown) to the secondary transfer roller 11. As a result, the toner images primarily transferred and superimposed on the outer circumference surface of the intermediate transfer belt 130 are secondarily transferred on a surface of the sheet 2 collectively. The sheet 2 on which the toner image is secondarily transferred is conveyed to a fixing device 170 as a fixing portion. The CPU 301 turns on a fixing heater (not shown) which is provided in the fixing device 170 and detects the fixing heater reaching a temperature determined in advance by a thermistor not shown.

In the course of nipping and conveying the sheet 2 by a heat rotating member (fixing roller) and a pressure rotating member (pressure roller) provided in the fixing device 170, the toner on the sheet 2 is thermally melted and pressurized by the sheet 2 to be fixed and conveyed to a downstream side in the fixing device 170.

During single-side printing, the sheet 2, which is discharged from the fixing device 170 and conveyed to a conveyance path 231 by a flapper 172, is nipped and conveyed by a conveying roller 232 and conveyed to a discharge conveyance path 181, and is nipped and conveyed by each discharge roller 13 and discharged onto a discharge tray 196.

Description will be made of a case of conveying the sheet 2 to a double-side conveyance path 230 configuring an inversion path which inverts front and back surfaces of the sheet 2 after printing of a front surface in duplex printing. The sheet 2 discharged from the fixing device 170 and conveyed to the double-side conveyance path 230 by the flapper 172 is nipped and conveyed by each conveying roller 14 and each reverse roller 15 and is conveyed to a leading path 16.

When a rear end portion in a travelling direction of the sheet 2 passes a flapper 17, the flapper 17 turns clockwise in FIG. 1, so that each reverse roller 15 reversely rotates to convey the sheet 2 to a reverse path 18 with the rear end portion of the sheet 2 in the travelling direction as a front end portion. Thereafter, the sheet is nipped and conveyed by respective conveying rollers 19 to join in a conveyance path 20. Then, the sheet 2 is discharged after having the back surface side subjected to the transfer and fixing steps similarly to the front surface.

<Sheet Deck>

Figure 3:
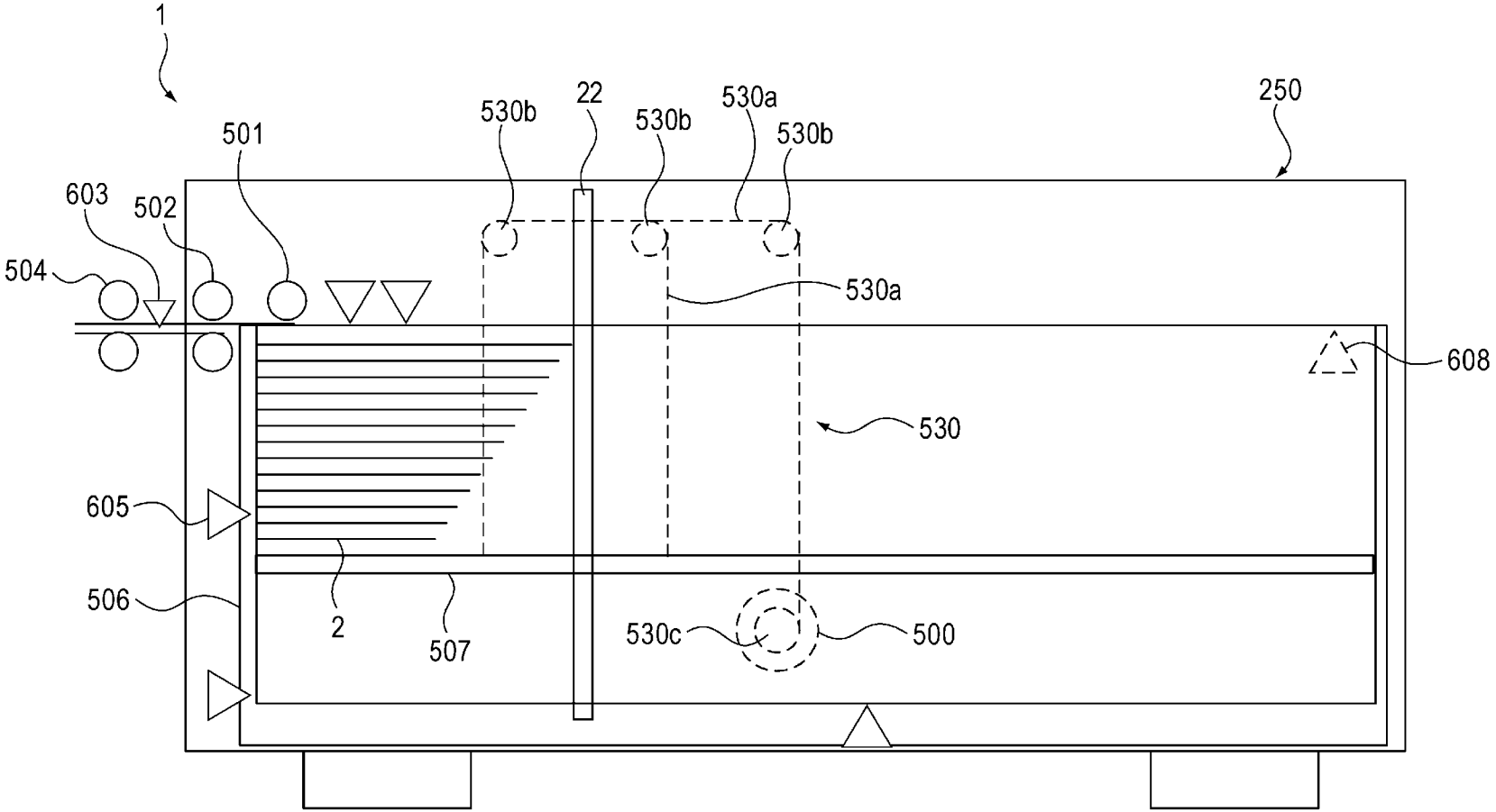
FIG. 3 is an explanatory sectional view showing a configuration of a sheet deck of the image forming apparatus.
Figure 4:
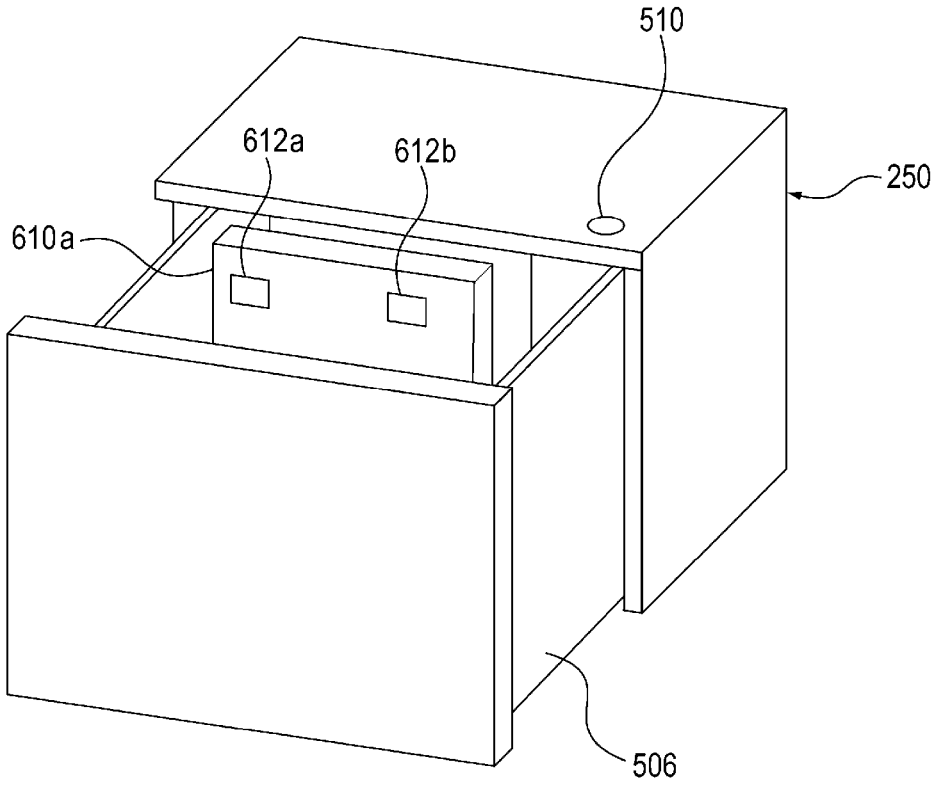
FIG. 4 is an explanatory perspective view showing the configuration of the sheet deck of the image forming apparatus.

Next, with reference to FIG. 3 and FIG. 4, a configuration of the sheet deck 250 will be described. FIG. 3 is an explanatory sectional view showing the configuration of the sheet deck 250 of the image forming apparatus 100. FIG. 4 is an explanatory perspective view showing the configuration of the sheet deck 250 of the image forming apparatus 100. The sheet deck 250 shown in FIG. 3 has a sheet feeding portion 1 which one by one feeds the sheets 2 stacked on the lift board 507 provided in the storage 506 so as to be capable of lifting and lowering.

<Sheet Feeding Portion>

The sheet feeding portion 1 has the box-shaped storage 506 as a sheet storage portion for storing a numbers of (plurality of) sheets 2. The storage 506 as the sheet storage portion is provided to be insertable/removable in/from the sheet deck. By drawing the storage 506 out of the sheet deck 250, the storage is opened to allow storage of the sheets and by inserting the storage 506 in the sheet deck 250, the storage is closed. The lift board 507 is further provided in the storage 506 so as to be capable of lifting and lowering, the lift board being a sheet stacking portion on which the plurality of sheets 2 is stacked. The pick-up roller 501 is further provided which feeds the sheet 2 stacked on the top on the lift board 507.

<Lifting and Lowering Mechanism>

A lifting and lowering mechanism 530 as a lifting and lowering portion which lifts and lowers the lift board 507 as the sheet stacking portion has a wire 530*a* which suspends and supports the lift board 507. The lifting and lowering mechanism 530 further has a plurality of driven pulleys 530*b* around which the wire 530*a* is wound, a driving pulley 530*c* to which the wire 530*a* is coupled, and the lifter motor 500 to which the driving pulley 530*c* is connected. Then, the lift board 507 is lifted by rotating the driving pulley 530*c* to have the wire 530*a* wounded around by the lifter motor 500.

The pick-up roller 501 is provided at a position above and opposed to a downstream side (the left side in FIG. 3) in a sheet feeding direction of the sheets 2 stacked on the lift board 507. The pick-up roller 501 lands on the top sheet 2 stacked on the lift board 507 and rotates clockwise in FIG. 3 to send out the sheet 2.

The storage 506 is provided with a partition plate 22 for regulating a position of the rear end portion, in a sheet conveyance direction, of the sheets 2 stacked on the lift board 507. A user manually moves the partition plate 22 so as to match a size of the sheets 2 stacked on the lift board 507 and cause the partition plate to abut on the rear end portion of the sheets 2 in the sheet conveyance direction. In this manner, the position of the rear end portion, in the sheet conveyance direction, of the sheets 2 stacked on the lift board 507 is regulated.

As shown in FIG. 4, on a top surface of the sheet deck 250, there is provided a storage opening/closing button 510 for pulling forward the storage 506 from the sheet deck 250. When a user presses the storage opening/closing button 510, the CPU 301 releases a storage opening/closing solenoid 23 shown in FIG. 2 which is provided in a storage latch member not shown which connects the sheet deck 250 and the storage 506.

This enables the storage 506 housed in the sheet deck 250 to be pulled forward to a front surface side (the front side in FIG. 4). The storage 506 is provided with a storage opening/closing detection sensor 608 shown in FIG. 3. The CPU 301 is capable of determining whether the storage 506 is being pulled forward to the front surface side or not on the basis of a detection result of the storage opening/closing detection sensor 608.

<Sheet Loosening>

Figure 5:
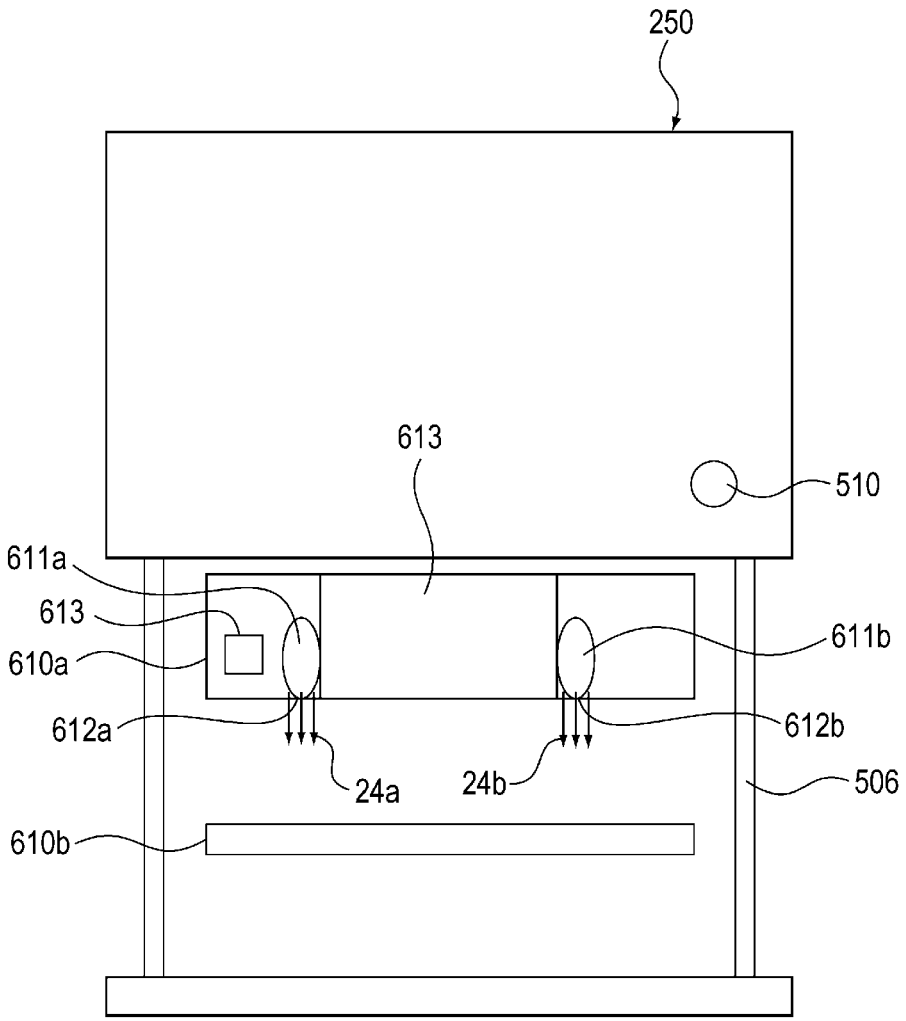
FIG. 5 is an explanatory plan view showing the configuration of the sheet deck of the image forming apparatus.

Next, with reference to FIG. 4 and FIG. 5, description will be made of a configuration of sheet loosening fans 611*a* and 611*b* and an air heater 613 provided in the sheet deck 250. FIG. 5 is an explanatory plan view showing the configuration of the sheet deck 250 of the image forming apparatus 100. As shown in FIG. 5, in the box-shaped storage 506 which stores the sheets 2, side regulating boards 610*a* and 610*b* are provided for regulating positions of both side end portions (right and left end portions) in a width direction of the sheets 2 stacked on the lift board 507, the width direction being orthogonal to the sheet conveyance direction of the sheets 2.

Of the side regulating boards 610*a* and 610*b*, one side regulating board 610*a* is provided with the sheet loosening fans 611*a* and 611*b* and the air heater 613. The sheet loosening fans 611*a* and 611*b* are configured as fans which spray air on the sheets 2 as recording media stacked on the lift board 507 as the sheet stacking portion. The air heater 613 is configured as a heater which heats air jetted from the sheet loosening fan 611*a*.

Spray ducts not shown are provided for the respective fans in the side regulating board 610*a*. The spray ducts are provided with openings 612*a* and 612*b*, respectively, for spraying a warm wind 24*a* and a wind 24*b* toward a side surface of a sheet bundle including a plurality of sheets 2 stacked and stored on the lift board 507 in the storage 506. The openings 612*a* and 612*b* are provided corresponding to a height position of the pick-up roller 501. Of the openings 612*a* and 612*b*, the warm wind 24*a* is sprayed from one opening 612*a* toward the side surface of the bundle of the sheets 2 stacked on the lift board 507, toward a position near the pick-up roller 501. The warm wind 24*a* enters between the sheets 2 stacked on the lift board 507 to loosen up and down sheets 2. The other opening 612*b* is provided downstream of the one opening 612*a* in the sheet feeding direction. The wind 24*b* is sprayed from the other opening 612*b* toward the side surface of the bundle of the sheets 2 stacked on the lift board 507. The wind 24*b* enters between the sheets 2 stacked on the lift board 507 to loosen up and down sheets 2.

The fan 611*a* and the air heater 613 are provided inside the spray duct, out of the spray ducts, which sprays the warm wind 24*a* toward a position near the pick-up roller 501. The fan 611*b* is provided inside the spray duct which sprays the wind 24*b* toward the side surface of the sheet bundle. As will be described later, a user selects feeding of the sheet 2 of a prescribed material such as coated paper via the display operation portion 310. As a result, the CPU 301 controls the heat of the air heater 613 and also controls the drive of the sheet loosening fans 611*a* and 611*b*.

Air in the spray duct in which the air heater 613 is provided is heated by the air heater 613 to be warm. Thereafter, rotation operation of the sheet loosening fan 611*a* results in spraying the warm wind 24*a* from the opening 612*a* toward the side surface of the sheets 2 stacked on the lift board 507 through the spray duct not shown. In this manner, moisture absorbed and adhered state of the sheets 2 stacked on the lift board 507 is relieved.

Similarly, the air (the wind 24*b*) in the spray duct on the side where no air heater is provided is sprayed from the opening 612*b* toward the side surface of the sheets 2 stacked on the lift board 507 by rotation operation of the sheet loosening fans 611*b*.

The sheet loosening fans 611*a* and 611*b* operate for a prescribed time (e.g. 15 seconds) to spray air on the sheet bundle including a plurality of sheets as initial loosening at the time of start of the power source of the image forming apparatus, at the time of closing/opening the sheet deck 250, and at the time of selecting a material of the sheet 2 by the display operation portion 310.

At the time of accepting JOB of conveying a sheet from the storage 506, the sheet loosening fans 611*a* and 611*b* operate for a prescribed time (e.g. eight seconds) to spray air on the stacked sheets. Then, after the state of air spraying on the stacked sheet is stabilized, conveyance by the pick-up roller 501 is started, and after the rear end of the sheet for the accepted JOB passes through the feeding sensor 603, the operation of the sheet loosening fans 611*a* and 611*b* is ended.

The CPU 301 determines an adjustment temperature of the air heater 613 according to various conditions to be described later. An environment sensor 614 shown in FIG. 2 is provided in the storage 506. The environment sensor 614 is a detection portion which detects temperature and humidity in the storage 506. The CPU 301 is capable of determining temperature and humidity in the storage 506 on the basis of a detection result of the environment sensor 614 as the detection portion.

<Sheet Moisture Content and Sheet Wrinkle>

Spray of warm wind on the sheet 2 has an advantage in increasing an effect of relieving adhesion between sheets caused by moisture and of loosening the sheets. On the other hand, an excessive difference in a moisture content between a sprayed portion and a non-sprayed portion of the sheet 2 causes uneven sheet deformation to generate sheet wrinkles in moisture evaporation and expansion and contraction occurring in the course of heating and pressurizing when the sheet 2 passes through the fixing device 170.

In order to solve these problems, it is necessary to control warm wind so as to reduce a moisture content difference in a sheet surface. Therefore, with respect to parameters of wind velocity, temperature, and spraying time, sensitivity of each parameter was verified in the present example. Experiment results obtained will be described below. The experiment results to be described in the following were obtained with a sheet of coated paper having a basis weight of 80 g and a size of A3.

<Wind Velocity and Moisture Content of Sheet>

Figure 6:
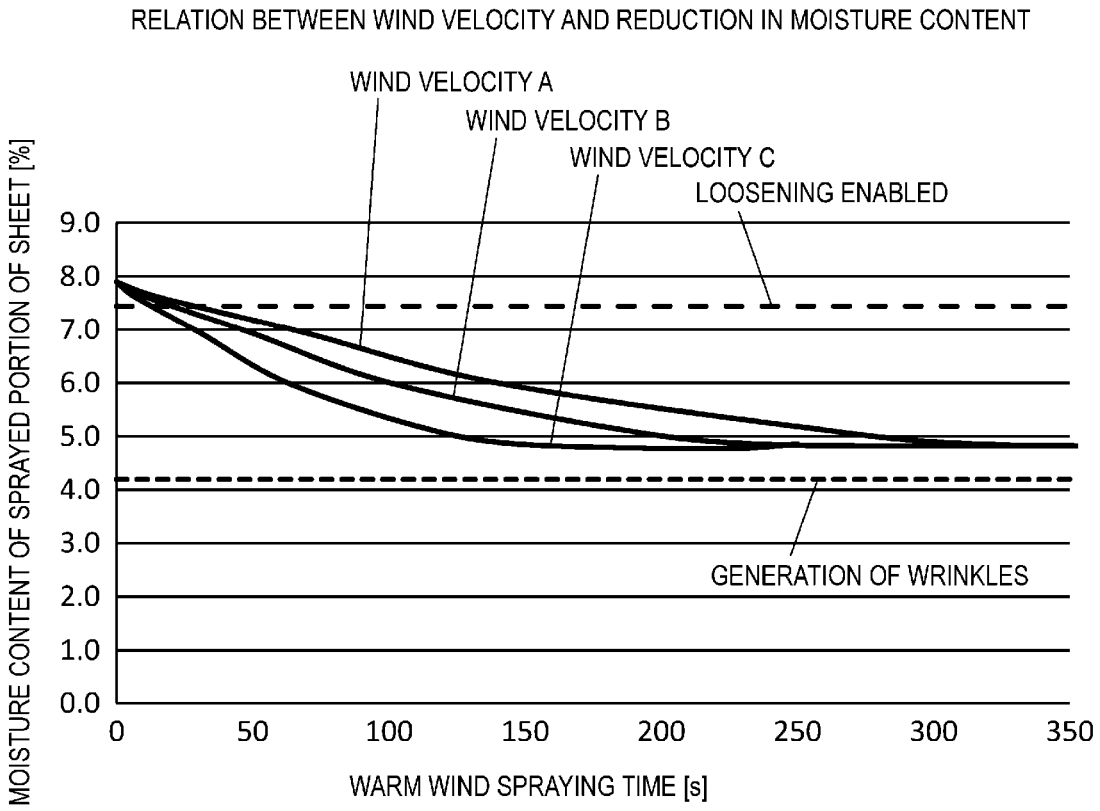
FIG. 6 is a graph showing a relation between a wind velocity of a sprayed portion and a reduction in a moisture content.

Relation between a wind velocity and a moisture content of a sheet will be described. FIG. 6 is a graph showing a reduction in a moisture content of a sheet when a wind velocity of a sprayed portion is changed with a heater temperature fixed. With a wind velocity A representing the lowest and a wind velocity C representing the highest (wind velocity A<wind velocity B<wind velocity C), the higher the wind velocity against the sheet becomes, the higher becomes a reduction rate of a moisture content in a sheet.

However, when the wind velocity is increased, sheet behavior becomes unstable to make contact unstable between a sheet and a pick-up roller, thereby causing feeding failure. Therefore, an upper limit of a usable wind velocity is determined by a basis weight of a sheet type, and a smaller a basis weight of a sheet becomes, the more the sheet is liable to be affected by wind. It is accordingly necessary to reduce a volume of air.

It is found from the above that for a sheet, such as coated paper with high smoothness, which is a thin paper, it is difficult, by spraying at fixed heater temperature setting as is done in conventional control, to loosen sheets while reducing time required before the sheets are allowed to be conveyed without generating sheet wrinkles.

<Warm Wind and Moisture Content of Sheet>

Figure 7:
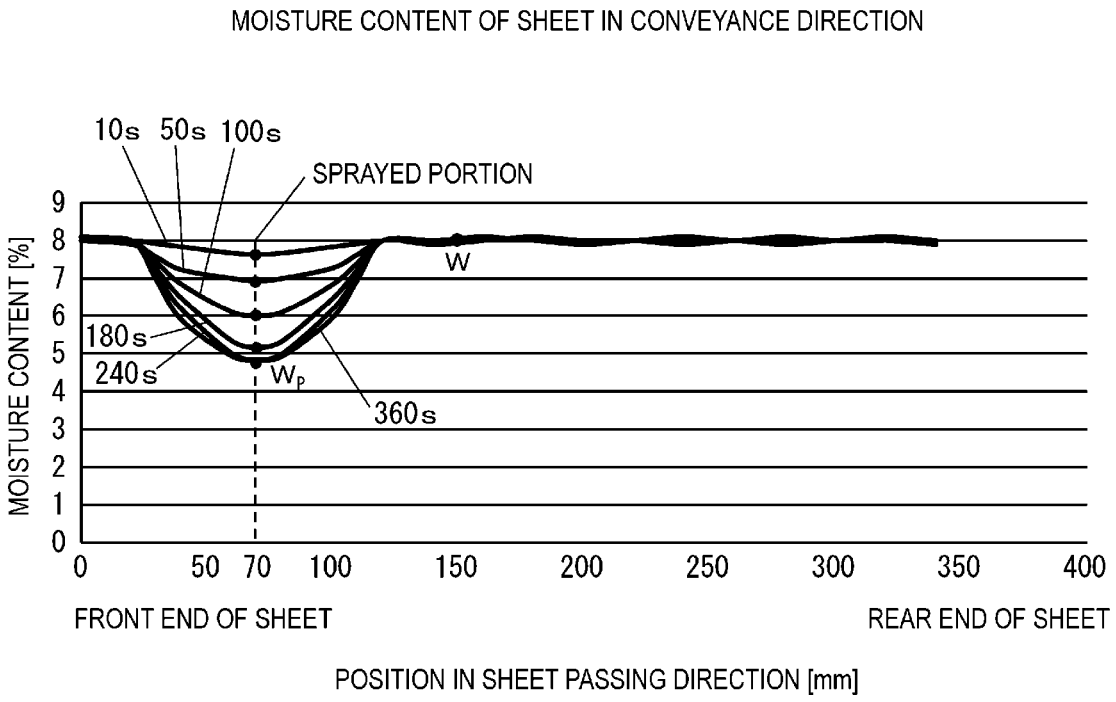
FIG. 7 is a graph showing one example of a moisture content change of a sheet in a conveyance direction.

Next, a relation between an adjustment temperature and a moisture content of a sheet will be described. FIG. 7 shows one example of an experiment result obtained when checking a change of a moisture content of a sheet in the conveyance direction when warm wind is applied to the sheet.

The warm wind 24*a* jetted from the opening 612*a* is sprayed around a prescribed range centered on a position 70 mm upstream in the conveyance direction from the front end of the sheet 2 stacked in the storage 506. Since a part of the sheet 2 to which the warm wind 24*a* is applied will gradually have a reduction in a moisture content, measurement of the moisture content of the sheet 2 every hour finds how the moisture content near the sprayed portion is reduced.

It is defined that among then sprayed portions, a moisture content of a part having a largest reduction in a moisture content in the sheet conveyance direction is represented as Wp and an average moisture content of the other parts having no reduction appearing in a moisture content by spraying is represented as W.

Figure 8:
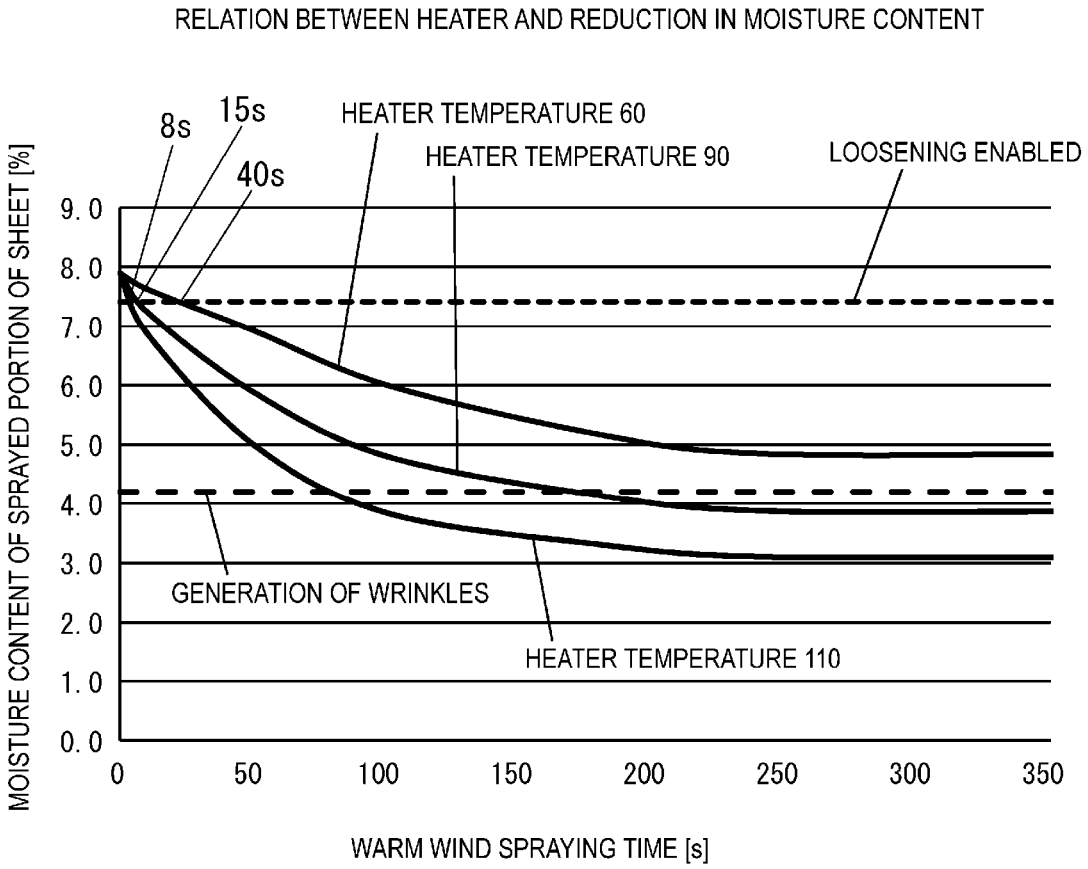
FIG. 8 is a graph showing a relation between a heater temperature and a reduction in a moisture content of the sprayed portion.

With respect to the moisture content Wp, FIG. 8 represents a change of the moisture content Wp on a time base. Comparison is made of transitions of the moisture content Wp obtained when the temperature of the air heater 613 is changed as 60° C., 90° C., and 110° C.

It is found from FIG. 8 that in comparison of gradients of the moisture content from the start of spray until after 50 seconds, the higher the temperature of the air heater 613 becomes, the larger the gradient of the moisture content of the sheet becomes, so that an amount of reduction in the moisture content per hour is increased.

Additionally, when the warm wind 24*a* is continuously applied for 300 seconds or more, a moisture content of the sheet will barely change. It is found that at this time, the higher the temperature of the air heater becomes, the lower becomes the moisture content of the sheet to which the warm wind 24*a* is continuously applied for 300 seconds or more.

Next, a condition for generation of overlapped feeding and sheet wrinkles will be specifically described.

In experiment for obtaining a condition for generation of overlapped feeding and sheet wrinkles, a sheet of coated paper having a basis weight of 80 g and a size of A3 is used under the environment of room temperature of 30° C. and humidity of 80%.

The review of the present inventor finds that a condition for relieving adhesion between the sheets as coated paper with a moisture content of 8% to feed the sheets without overlapped feeding is to reduce a value of the moisture content Wp down to 7.4%.

At this time, while the spraying time of the warm wind 24*a* is about 40 seconds when the heater temperature is, for example, 60° C., the spraying time is about 15 seconds when the heater temperature is 90° C. and is about eight seconds when the heater temperature is 110° C.

It is also found that a condition for generation of sheet wrinkles when the sheet passes through the fixing device 170 is that the value of the moisture content Wp is below 4.2%.

With the spraying time of the warm wind 24*a* at this time, in a case of the heater temperature of 60° C., even when time elapses, no sheet wrinkle is generated. However, sheet wrinkles are generated when the spraying time of the warm wind 24*a* is 170 seconds or more in a case of the heater temperature of 90° C. and when the spraying time is 80 seconds or more in a case of the heater temperature of 110° C.

<Relation Between Stack and Warm Wind>

Next, consideration will be given to spraying time of a warm wind to the sheets stacked on the lift board 507. As recited in the section <Sheet Loosening>, the warm wind 24*a* is sprayed toward a position near the pick-up roller 501 from the spray duct provided in the sheet deck 250. The warm wind 24*a* enters between the sheets 2 stacked on the lift board 507 to loosen the sheets 2. On this occasion, the warm wind 24*a* enters the sheets 2 stacked on the sheet deck 250, the first to about 20th sheets from the top, to generate a loosened state. In sheet feeding, the sheets 2 stacked on the sheet deck 250 are sequentially conveyed from the top.

Here, spraying time of a warm wind to stacked sheets will be estimated. The first sheet from the top stacked on the sheet deck 250 is sprayed with the warm wind 24*a* for a time period in which the sheet loosening fan 611*a* is driven from the turning-on of the power source until the start of first feeding. Next, the second sheet from the top stacked on the sheet deck 250 will be subjected to spraying of the warm wind 24*a* for a time period longer than the first sheet by the time required for conveying the first sheet without fail. Then, the third sheet from the top stacked on the sheet deck 250 will be subjected to spraying of the warm wind 24*a* for a time period longer than the second sheet by the time required for conveying the second sheet without fail. Hereinafter, the following sheets up to about 20th sheet from the top stacked on the sheet deck 250 will be each similarly subjected to spraying of a little more warm wind 24*a* than that to which one preceding sheet stacked is subjected. Additionally, the 21th and following sheets will be each subjected to spraying of the warm wind 24*a* for a time period in which the sheet loosening fan 611*a* is driven from the start of feeding of about 20 sheets stacked above the sheet in question until the start of feeding of the sheet in question.

Thus, the spraying time of a warm wind on stacked sheets varies with a position of stacked sheets in a stacking direction.

In the present example, therefore, a warm wind temperature of a loosening air to be initially applied is set high in order to allow the first sheet to be fed as soon as possible and preventing overlapped feeding.

For the coated paper (basis weight of 80 g, A3 size) used in the experiment, for example, by setting initial heater adjustment temperature (first temperature) to be 90° C., the sheet is made to have a moisture content of 7.4% or less in 15 seconds.

Additionally, in order to prevent a moisture content of the sheet from becoming a fixed value or less even when a warm wind is continuously applied to sheet wrinkles for a long period of time, a heater adjustment temperature is changed from the initial heater adjustment temperature (the first temperature) to a second temperature lower than the first temperature after a lapse of fixed time (50 seconds).

For the coated paper (basis weight of 80 g, A3 size) used in the experiment, for example, the heater adjustment temperature is set such that the moisture content Wp will not become 4.2% or less. Specifically, in a case where the sheet loosening fan 611*a* is driven for the fixed time (50 seconds) or more at the first temperature, the heater adjustment temperature is set to be 60° C. (second temperature) lower than 90° C. (the first temperature).

The CPU 301 as a controller controls the drive of the fans 611*a* and 611*b* and also controls the heat of the air heater 613. The CPU 301 controls the heat of the air heater 613 at the first temperature (adjustment temperature 1) while drive time T2 of the fan 611*a* which sprays the warm wind 24*a* on the sheet is less than a threshold value (T2<50) set in advance. When the drive time of the fan 611*a* becomes the threshold value or more, the heat of the air heater 613 is controlled at the second temperature (adjustment temperature 2) lower than the first temperature. Specific description of the control will be made below.

<Sheet Loosening Control>

Figure 9A:
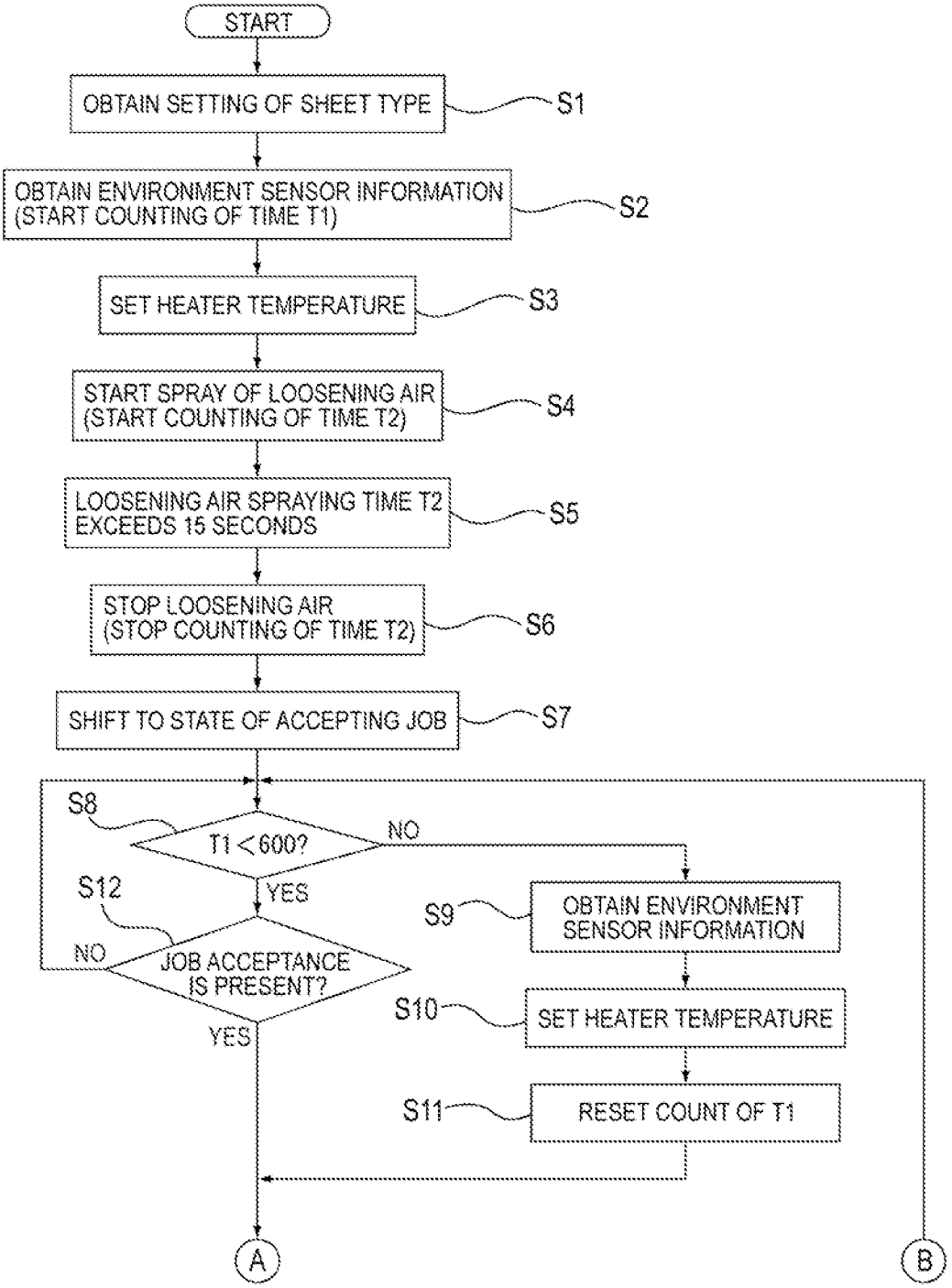
FIG. 9A and FIG. 9B are a flow chart showing control of a heater temperature.
Figure 9B:
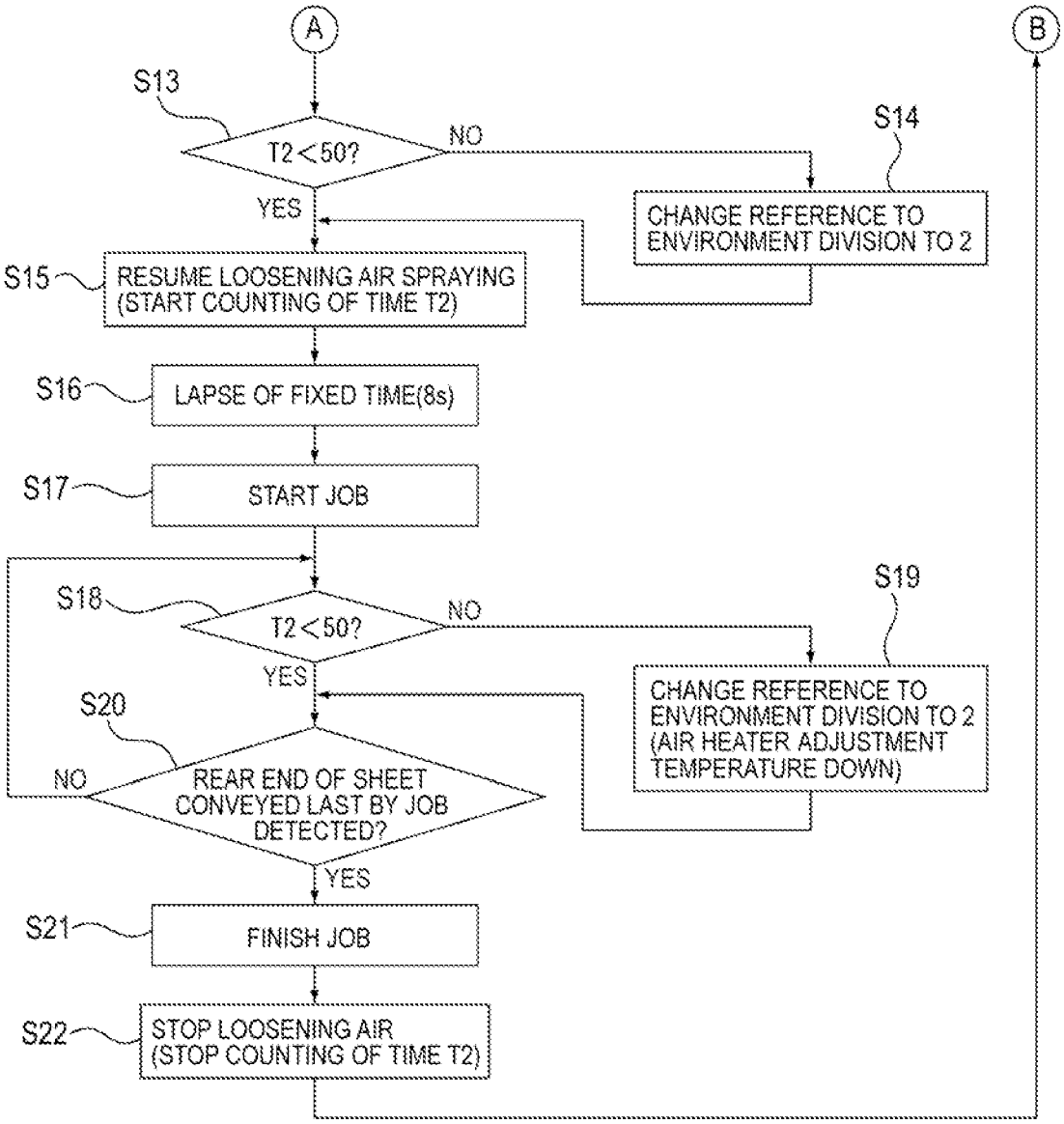

Next, with reference to FIG. 9 and FIG. 10, description will be made of sheet loosening control taking a moisture content included in the sheet 2 into consideration. FIG. 9 is a flow chart showing control of the loosening fan and the heater. FIG. 10 is a diagram for describing one example of division for values of temperature and humidity taken by the environment sensor 614. FIG. 10 illustrates coated paper classified into three divisions according to a difference in a basis weight, in which for each basis weight of the three divisions, the first temperature (the adjustment temperature 1) and the second temperature (the adjustment temperature 2) lower than the first temperature are used for the air heater.

The CPU 301 obtains setting data of a sheet input via the display operation portion 310 (S1). Thereafter, the CPU 301 obtains data of temperature and humidity in the storage 506 from the environment sensor 614. On this occasion, the CPU 301 starts counting environment update time T1 upon data acquisition of the environment sensor 614 as a trigger (S2).

Next, a temperature of the air heater is determined to start heating on the basis of the setting of the adjustment temperature 1 (the first temperature) shown in the environment division shown in FIG. 10 according to the above setting of the sheet (S3). Details of the environment division in FIG. 10 will be described later in <Environment Division>.

Next, as the initial loosening for eliminating adhesion caused by sheet moisture and reducing a time period before conveyance is allowed, the sheet loosening fans 611*a* and 611*b* are driven to start spray of loosening air (S4). On this occasion, the CPU 301 starts counting the drive time T2 of the fans 611*a* and 611*b* and checks a lapse of a fixed time (e.g. 15 seconds) as the drive time T2 in order to ensure a spraying time of a loosening air (warm wind and wind) until the sheet adhesion is eliminated (S5).

Thereafter, the sheet loosening fans 611*a* and 611*b* are stopped to stop the spraying of the loosening air. On this occasion, the CPU 301 stops counting the drive time T2 (S6). Then, the processing proceeds to a state of accepting JOB (S7).

Next, the CPU 301 determines whether a fixed time (e.g. 600 seconds) has elapsed as the environment update time T1 when counting started in Step S2 (S8).

In a case where 600 seconds or more has elapsed as the environment update time T1 in Step S8, temperature and humidity data in the storage is again obtained by the environment sensor 614 (S9). Then, a heater temperature in the environment division in FIG. 10 is determined according to setting of the sheet based on the obtained temperature and humidity data (S10). Thereafter, the count of the environment update time T1 is reset (S11).

In a case where 600 seconds has not yet elapsed as the environment update time T1 in Step S8, the processing directly proceeds to Step S12.

Determination is made in Step S12 whether JOB start is present or not (S12), and when no JOB is present, the processing directly proceeds to Step S8.

In a case where JOB is present in Step S12, determination is made whether the drive time T2 of the fans 611*a* and 611*b* is shorter than a fixed time (e.g. 50 seconds) or not (S13).

In a case where the drive time T2 is longer than the fixed time (e.g. 50 seconds) in Step S13, the CPU 301 determines that the temperature of the warm wind of the loosening air should be decreased and changes a set value to be referred to of the air heater to the adjustment temperature 2 (the second temperature) in the environment division in FIG. 10 (S14).

In a case where the drive time T2 is shorter than the fixed time (e.g. 50 seconds) in Step S13, the processing directly proceeds to Step S15.

In Step S15, the fans 611*a* and 611*b* are driven to bring about the sheet loosened state. On this occasion, count of the drive time T2 by the CPU 301 is resumed (S15).

Thereafter, a lapse of a fixed time (e.g. eight seconds) from Step S15 is checked as time before the loosened state is stabilized (S16).

Next, conveyance of the sheet 2 is started by JOB in Step S17. During the conveyance of the sheet, the fans 611*a* and 611*b* continue operation and counting of the drive time T2 is also continued.

Thereafter, determination is made whether the drive time T2 of the fans 611*a* and 611*b* is shorter than the fixed time (e.g. 50 seconds) or not (S18).

In a case where the drive time T2 is longer than the fixed time (e.g. 50 seconds) in Step S18, the set value of the air heater is changed to the adjustment temperature 2 (the second temperature) in the environment division in FIG. 10 (S19).

In a case where the drive time T2 is shorter than the fixed time (e.g. 50 seconds) in Step S18, the processing directly proceeds to Step S20.

In Step S20, passing of the rear end of the sheet 2 conveyed last by JOB through the feeding sensor 603 is checked.

In a case where passing of the sheet 2 conveyed last is not confirmed by the feeding sensor 603 in Step S20, the processing proceeds to Step S18.

In a case where passing of the sheet 2 conveyed last is confirmed by the feeding sensor 603 in Step S20, determination is made that JOB is finished (S21). Thereafter, the fans 611*a* and 611*b* are controlled to stop driving (S22).

Additionally, in this control, the drive time T2 of the fans 611*a* and 611*b* is reset at a time point where the power of the image forming apparatus 100 is applied, or at a time point of opening/closing of the storage 506.

The present example obtains the effect of suppressing a partial reduction of a moisture content of a sheet to suppress wrinkles of the sheet by controlling the loosening fan and the heater as described above.

<Environment Division>

FIG. 10 is a diagram for describing one example of a division with respect to values of temperature and humidity taken from the environment sensor 614. Since air discharged from the sheet loosening fan 611*a* is supplied from the storage, temperature and humidity of the air discharged from the sheet loosening fan 611*a* changes according to environment conditions in the storage. Therefore, it is necessary to change the temperature of the air heater 613 on the basis of information of the environment sensor 614 installed in the storage 506.

In FIG. 10, it is shown that in a case, for example, where humidity in the storage 506 is 46 to 60[%], temperature is 26 to 35° C., and sheet information includes coated paper with a basis weight of 70 to 110 g, the temperature of the air heater 613 is set to be 60° C. as recited in the first adjustment temperature (the first temperature).

It is also controlled in Step S14 or Step S19 shown in FIG. 9 to change the heater temperature to the adjustment temperature 2 (the second temperature). In FIG. 10, it is shown that in a case, for example, where humidity in the storage 506 is 46 to 60 [%], temperature is 26 to 35° C., and sheet information includes coated paper with a basis weight of 70 to 110 g, the temperature of the air heater 613 is set to be 45° C. as recited in the adjustment temperature 2 (the second temperature).

Temperature and humidity data is obtained from the environment sensor 614 at a fixed interval (the environment update time T1) to compare the obtained data with preceding temperature and humidity data before the acquisition, and when the obtained temperature and humidity data has a change, the heater adjustment temperature is updated according to the division shown in FIG. 10.

The above update is conducted, for example, by obtaining temperature and humidity data of the environment sensor 614 every 600 seconds in the present example. However, in a case where the CPU 301 is conducting other processing such as feeding as JOB, update determination is not conducted even after a lapse of 600 seconds.

<Adjustment of Heater Temperature>

Temperature required for loosening a sheet changes with a sheet type. For example, with respect to a sheet in the same division of a coated paper, adhesion of a stacked sheet varies with smoothness of the sheet.

Also with respect to sheets with the same basis weight, rigidity might vary with the sheets, and even sheets with the same moisture content difference might have different threshold values for wrinkle generation. Therefore, there is provided a mode of changing a temperature set value of the warm wind 24*a* for each sheet type.

There are provided here a first mode of uniformly increasing the first temperature and the second temperature at which heat of the air heater is controlled from a temperature according to a type of the sheet by a prescribed temperature, and a second mode of uniformly decreasing a temperature according to a type of the sheet by a prescribed temperature.

In a case, for example, where in continuous sheet passing, when JAM or overlapped feeding occurs, a sheet moisture content difference is small and the sheet loosening effect is not sufficient. In such a case, therefore, the mode is changed to the first mode. Specifically, the mode is changed to the mode of increasing the loosening effect by uniformly increasing the temperature of the air heater according to a set sheet type from a temperature recited in the adjustment temperature division (the adjustment temperature 1 or the adjustment temperature 2) by a prescribed temperature (5° C. here).

On the other hand, when sheet wrinkles are generated, the sheet has a large moisture content difference. In such a case, therefore, the mode is changed to the mode of relieving a moisture content difference by uniformly decreasing the temperature of the air heater according to a set sheet type from a temperature recited in the adjustment temperature division (the adjustment temperature 1 or the adjustment temperature 2) by a prescribed temperature (5° C. here).

This enables heater temperature setting according to smoothness and rigidity of each set type of sheet, by which overlapped feeding and generation of sheet wrinkles are suppressed.

Second Example

Next, an image forming apparatus according to a Second Example will be described with reference to FIG. 10 and FIG. 11. In the present example, air heater control of the sheet deck differs from the above First Example. Since the remaining configuration is the same as the above First Example, the same reference signs will be applied thereto to omit detailed description thereof.

<Relation Between Length of Sheet in Conveyance Direction and Sheet Wrinkle>

When uneven sheet deformation occurs at the time of passing of the sheet 2 through the fixing device 170, the sheet becomes uneven in the conveyance direction. Unevenness generated in the conveyance direction will cause the sheet to have skew as conveyance proceeds. The sheets pass through the fixing nip while overlapping with each other due to the skew and are crushed to generate sheet wrinkles. Therefore, a shorter sheet is likely to have less sheet wrinkles.

<Relation Between Length of Sheet in Conveyance Direction and Reduction in Moisture Content>

A sheet passing time varies with a length of a sheet in a sheet conveyance direction. As compared with, for example, a sheet having a length in the sheet conveyance direction of 210 mm, a sheet having a length in the sheet conveyance direction of 420 mm, when a sheet conveyance speed is the same, will require approximately double the time for passing of one sheet.

As described in First Example, the sheets 2 stacked on the sheet deck 250 are affected by the warm wind 24*a* until having its turn come after passing of about 20 sheets.

In the meantime, the warm wind 24*a* is sprayed on the sheets 2 stacked on the sheet deck 250. Therefore, as compared with the sheet having the length in the sheet conveyance direction of 210 mm, the sheet having the length in the sheet conveyance direction of 420 mm, when the sheet conveyance speed is the same, will require approximately double the spraying time by passing.

Accordingly, the temperature of the warm wind 24*a* is controlled according to a length of the sheet in the conveyance direction. Specifically, in the present example, in a case where the length of the sheet 2 in the conveyance direction is a prescribed length (e.g. 220 mm) or more, the temperature of the warm wind 24*a* is controlled to be reduced. As a result, sheet wrinkles can be suppressed. Detailed description will be made thereof in the following.

<Sheet Loosening Control According to Sheet Length>

Figure 11A:
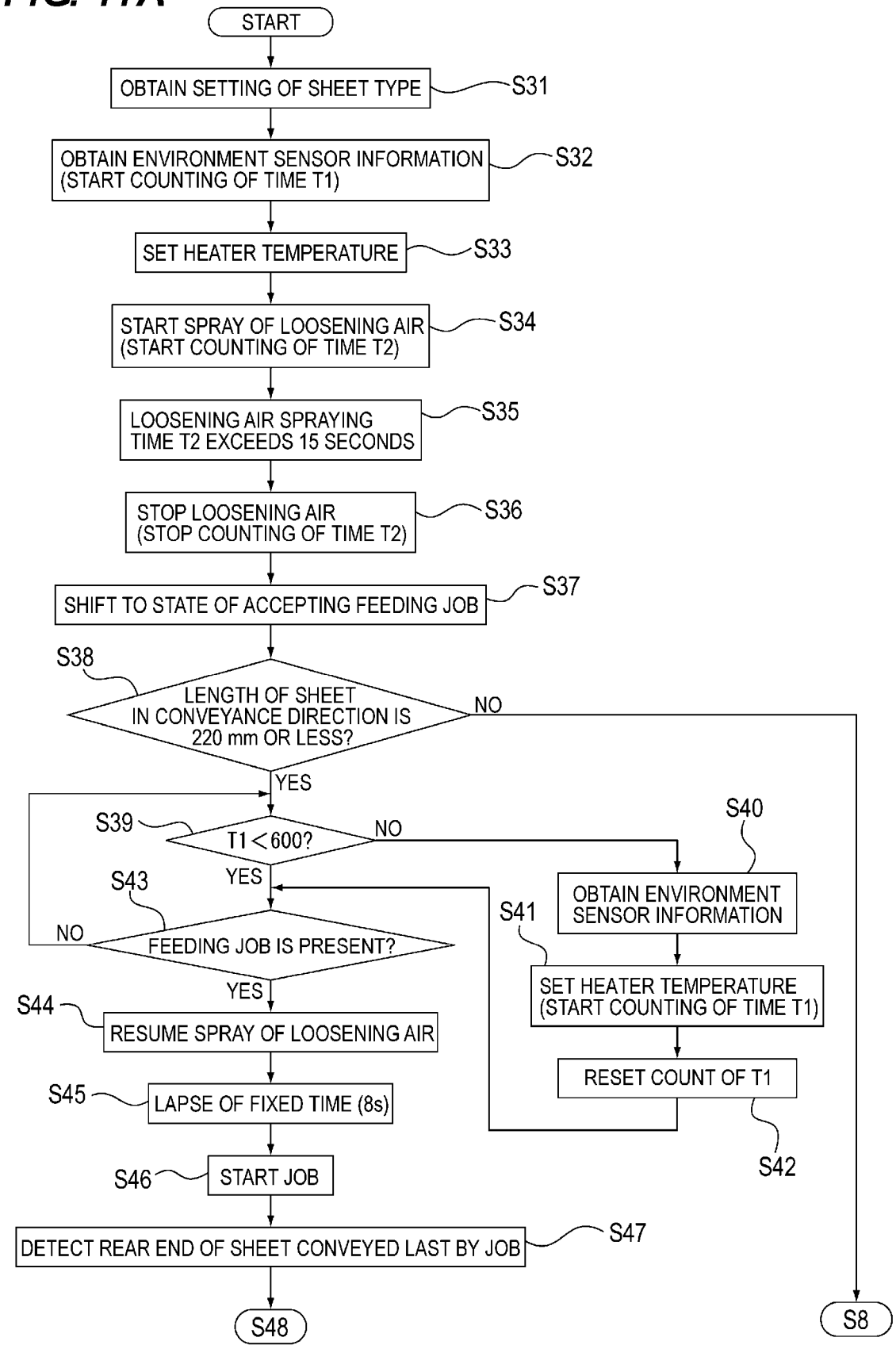
FIG. 11A and FIG. 11B are a flow chart showing control of a heater temperature taking a length of a sheet in the conveyance direction into consideration.
Figure 11B:
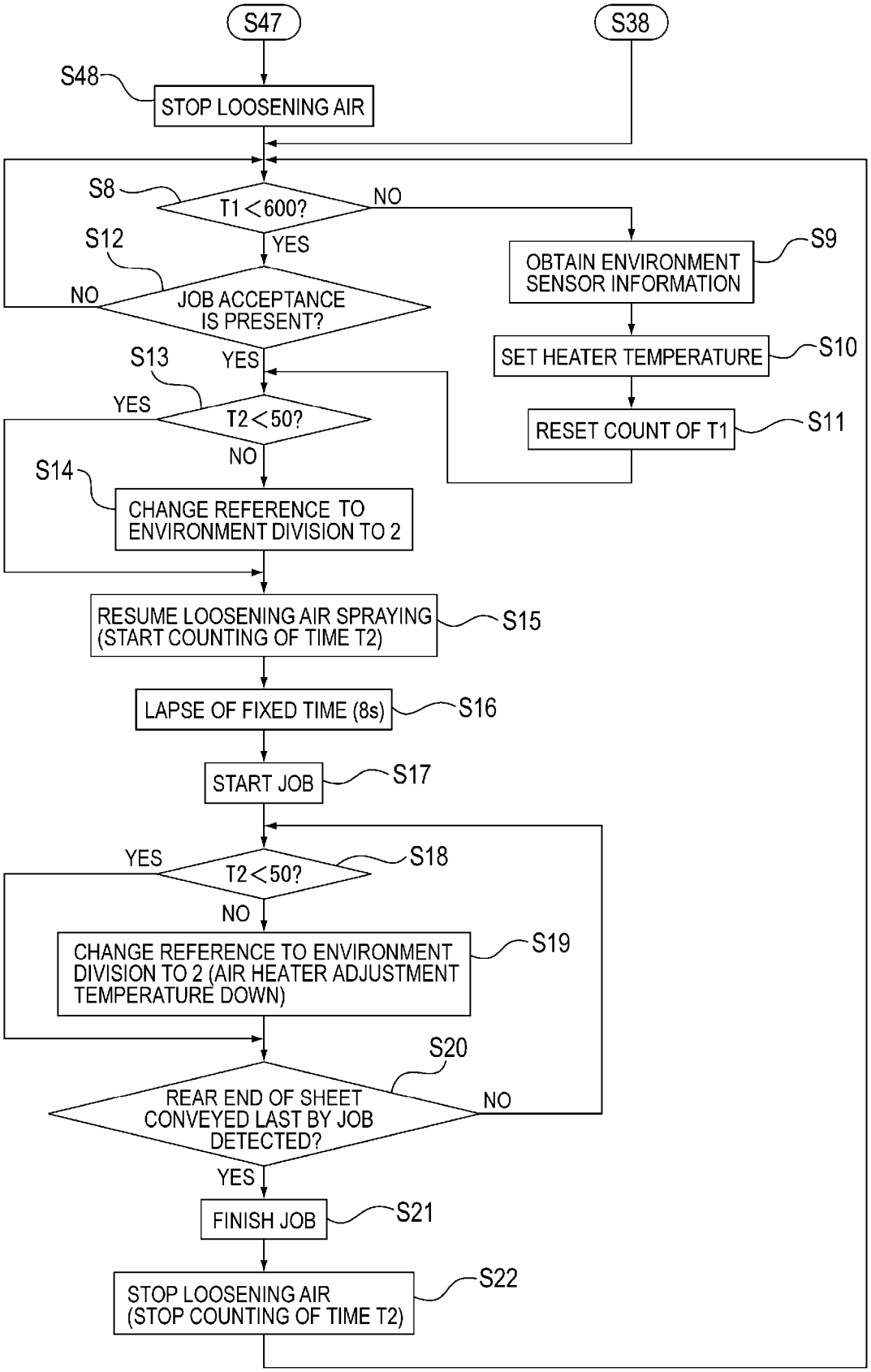

FIG. 11 is a flow chart showing control of the loosening fan and the heater taking a length of a sheet in the conveyance direction into consideration.

The CPU 301 obtains setting data of a sheet input via the display operation portion 310 (S31), and thereafter, obtains data of temperature and humidity in the storage 506 by the environment sensor 614. On this occasion, the CPU 301 starts counting the environment update time T1 upon data acquisition of the environment sensor 614 as a trigger (S32).

Next, a temperature of the air heater is determined to start heating on the basis of the setting of the adjustment temperature 1 (the first temperature) shown in the environment division shown in FIG. 10 according to the above setting of the sheet (S33). The environment division in FIG. 10 is as described in the above <Environment Division>.

Next, as the initial loosening for eliminating adhesion caused by sheet moisture and reducing a time period before conveyance is allowed, the sheet loosening fans 611*a* and 611*b* are driven to start spray of the loosening air (S34). On this occasion, the CPU 301 starts counting the drive time T2 of the fans 611*a* and 611*b* and checks a lapse of a fixed time (e.g. 15 seconds) as the drive time T2 in order to ensure a spraying time of a loosening air (warm wind and wind) until the sheet adhesion is eliminated (S35).

Thereafter, the sheet loosening fans 611*a* and 611*b* are stopped to stop the spraying of the loosening air. On this occasion, the CPU 301 stops counting the drive time T2 (S36). Then, the processing proceeds to a state of accepting JOB (S37).

Next, the CPU 301 determines in Step S38 whether or not the length of the sheet in the conveyance direction is a prescribed length (e.g. 220 mm) or less (S38). In a case where the length of the sheet in the conveyance direction is not or not less than the prescribed length (e.g. 220 mm) in Step S38, i.e. where the length of the sheet in the conveyance direction is longer than 220 mm, the processing proceeds to Step S8.

Since control in Step S8 and the following steps (Steps S8 to S22) is the same as that described in the above First Example, description thereof will be omitted.

When in Step S38, the length of the sheet in the conveyance direction is the prescribed length (e.g. 220 mm) or less, the processing proceeds directly to Step S39.

In Step S39, the CPU 301 determines whether a fixed time (e.g. 600 seconds) has elapsed or not as the environment update time T1 whose counting is started in Step S32 (S40).

In a case where 600 seconds or more has elapsed as the environment update time T1 in Step S39, temperature and humidity data in the storage is again obtained by the environment sensor 614 (S40). Then, a heater temperature in the environment division in FIG. 10 is determined according to setting of the sheet based on the obtained temperature and humidity data (S41). Thereafter, the count of the environment update time T1 is reset (S42).

In a case where 600 seconds has not yet elapsed as the environment update time T1 in Step S39, the processing directly proceeds to Step S43.

Determination is made in Step S43 whether JOB start is present or not (S43), and when no JOB is present, the processing directly proceeds to Step S39.

In a case where JOB is present in Step S43, the fans 611*a* and 611*b* are driven to bring about the sheet loosened state (S44).

Thereafter, a lapse of a fixed time (e.g. eight seconds) is checked as time from Step S44 until the loosened state is stabilized (S45).

Then, conveyance of the sheet 2 is started by JOB in Step S46.

After feeding by JOB, passing of the rear end of the sheet 2 conveyed last by JOB through the feeding sensor 603 is checked in Step S47.

After passing of the sheet 2 conveyed last is confirmed by the feeding sensor 603 in Step S47, the CPU 301 determines that the need of loosening a sheet is eliminated and conducts control to stop driving of the fans 611*a* and 611*b* (S48).

Also in the present example, by controlling the loosening fan and the heater in the manner as described above, even when the sheet varies in a length in the conveyance direction, a partial reduction in a moisture content of the sheet can be suppressed to obtain the effect of suppressing wrinkles of the sheet.

Third Example

Next, an image forming apparatus according to a Third Example will be described with reference to FIG. 12. In the present example, air heater control in the sheet deck is different from those of the above First Example and Second Example. Since the remaining configuration is the same as the above First Example, the same reference signs will be applied thereto to omit detailed description thereof.

While in First Example and Second Example, a moisture content of the sheet 2 is controlled by changing an adjustment temperature of the air heater, in the present example, a moisture content of the sheet 2 is controlled using ON/OFF of the air heater. Detailed description thereof will be made below.

<ON/OFF Control of Air Heater>

In the present example, close adhesion between sheets is eliminated by spraying the warm wind 24*a* heated by the air heater 613 toward the side surface of the sheets 2 stacked on the lift board 507 to loosen the sheets 2. On this occasion, control is conducted of loosening the sheet 2 with the warm wind 24*a* heated by the air heater 613 while estimating a moisture content of the sheet 2. Therefore, it is possible to control a moisture content included in the sheet 2 be to be appropriately maintained.

Figure 12:
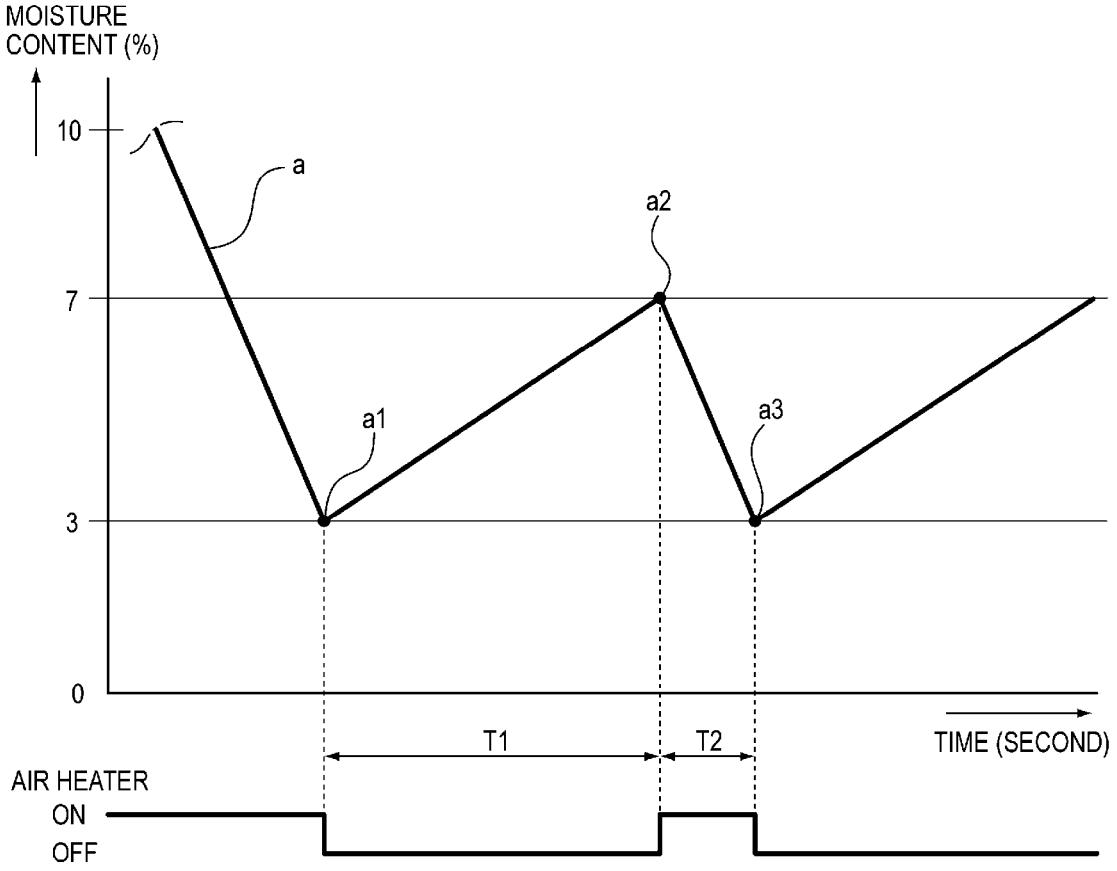
FIG. 12 is a graph showing a condition for ON/OFF of the heater.

In a graph a shown in FIG. 12, the vertical axis represents a moisture content included in the sheet 2 and the horizontal axis represents a lapse of time. Such a graph a as shown in FIG. 12 is prepared in advance on the basis of paper quality of the sheet 2 and conditions for environment temperature and humidity.

In the present example, the CPU 301 measures duration time from ON to OFF of the air heater 613 and duration time from OFF to ON of the air heater 613 by using a timer 26 (see FIG. 2) as a measurement portion.

First, the CPU 301 sprays the sheets 2 stacked on the lift board 507 with the warm wind 24*a* and the wind 24*b* (see FIG. 5) heated by the air heater 613 by means of the fans 611*a* and 611*b*, respectively. At this time, when the drive time of the fan 611*a* exceeds a prescribed time, the CPU 301 turns off the air heater 613. OFF of the air heater 613 here is the first OFF shown in FIG. 12 (a1 in the figure). Also, a prescribed time here is time for evaporating moisture contained in a sheet. The time for evaporating moisture contained in a sheet ranges from time when the sheet is allowed to be loosened to time when wrinkles of the sheet are suppressed, and is appropriately set according to a type of sheet, environment conditions (temperature and humidity), and temperature of the heater.

The CPU 301 further measures a first duration time from OFF to ON of the air heater by using the timer 26 as the measurement portion (see FIG. 2). Then, the CPU 301 turns on the air heater upon arrival of the first duration time after turn-off of the air heater at a first threshold value t1 set in advance. Here, the first duration time is time from first OFF (a1 in the figure) until first ON (a2 in the figure) as shown in FIG. 12.

The CPU 301 further measures a second duration time from ON to OFF of the air heater by using the timer 26 as the measurement portion (see FIG. 2). Then, the CPU 301 turns off the air heater upon arrival of the second duration time after turn-on of the air heater at a second threshold value t2 set in advance. Here, the second duration time is time from first ON (a2 in the figure) until subsequent OFF (a3 in the figure) as shown in FIG. 12.

By thus controlling a moisture content of the sheet 2 using ON/OFF of the air heater, a partial reduction in a moisture content included in the sheet 2 can be suppressed to obtain the effect of suppressing wrinkles of the sheet.

Although illustration is here made of a case where a moisture content which enables sheets to be loosened as timing for turning on the air heater is set to be 7% and a moisture content which enables wrinkles of a sheet to be suppressed as timing for turning off the air heater is set to be 3% as shown in FIG. 12, the invention is not limited thereto. Ranges of the moisture content which enables sheets to be loosened and the moisture content which enables wrinkles of a sheet to be suppressed as timing for turning on/off the air heater can be appropriately set according to a type of sheet, environment conditions (temperature and humidity), and temperature of the heater.

Additionally, the above Examples illustrate the configuration in which the heater and the fan are provided in the sheet deck, the invention is not limited thereto. It is possible to, for example, provide the sheet cassette with the fan and the heater to conduct control in the same manner. Such configuration can obtain the same effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-142125, filed Jul. 30, 2018, which is hereby incorporated by reference herein in its entirety.

What is claimed is:

1. An image forming apparatus comprising:

a sheet storage portion in which a plurality of sheets is stored;

a heater which heats air;

a fan which sprays air on the sheet stored in the sheet storage portion; and a controller which controls the heat of the heater and controls the drive of the fan, wherein in a case that a length of the sheet in a conveying direction of the sheet exceeds a predetermined length, the controller controls the heat of the heater at a first temperature before a drive time of the fan reaches a threshold value set in advance, the drive time being in which the fan sprays air heated by the heater on the sheet, and when the drive time of the fan reaches or exceeds the threshold value set in advance, controls the heat of the heater at a second temperature lower than the first temperature, and wherein in a case that the length of the sheet in the conveying direction of the sheet is equal to or less than the predetermined length, the controller controls the heat of the heater at the first temperature and the sheet is blown by the fan with heated air.

2. The image forming apparatus according to claim 1, further comprising:

an operation portion which inputs sheet information, wherein a mode is provided of changing the first temperature and the second temperature at which the heat of the heater is controlled according to a type of sheet set by the operation portion.

3. The image forming apparatus according to claim 2, wherein there are provided a first mode of uniformly increasing the first temperature and the second temperature at which heat of the heater is controlled from a temperature according to a type of the sheet by a prescribed temperature and a second mode of uniformly decreasing the temperatures from the temperature according to a type of the sheet by a prescribed temperature.

4. The image forming apparatus according to claim 1, further comprising:

a detection portion which detects temperature and humidity inside the sheet storage portion, wherein the controller changes the first temperature and the second temperature at which heat of the heater is controlled on the basis of the temperature and humidity detected by the detection portion.

5. The image forming apparatus according to claim 4, wherein when an environment update time set in advance has elapsed after the detection portion obtains temperature and humidity, the controller newly obtains temperature and humidity by the detection portion and changes the first temperature and the second temperature at which heat of the heater is controlled on the basis of the newly obtained temperature and humidity.

6. The image forming apparatus according to claim 1, wherein the sheet storage portion is provided to be insertable/removable in/from the image forming apparatus, and wherein the controller resets the drive time of the fan at a time point where power of the image forming apparatus is applied, or at a time point where the sheet storage portion is inserted.

* * * * *